US012324992B1

(12) United States Patent
Yu

(10) Patent No.: US 12,324,992 B1
(45) Date of Patent: Jun. 10, 2025

(54) SCENE DECORATION ARTICLE

(71) Applicants: Qingxin Yu, Guangdong (CN); Lijiao Zhao, Sichuan (CN)

(72) Inventor: Qingxin Yu, Guangdong (CN)

(73) Assignee: Lijiaso Zhao, Sichuan (CN)

( * ) Notice: Subject to any disclaimer, the term of this patent is extended or adjusted under 35 U.S.C. 154(b) by 0 days.

(21) Appl. No.: 19/009,934

(22) Filed: Jan. 4, 2025

(30) Foreign Application Priority Data

Dec. 20, 2024 (CN) ..... 202423193207.3

(51) Int. Cl.
*G09F 13/24* (2006.01)
*A63J 5/00* (2006.01)

(52) U.S. Cl.
CPC ..... *A63J 5/00* (2013.01)

(58) Field of Classification Search
CPC ..... G09F 13/24; G09F 19/00; G09F 19/02
See application file for complete search history.

(56) References Cited

U.S. PATENT DOCUMENTS 4,047,633 A * 9/1977 Trombly ..... B65D 11/16 220/592.2
4,961,276 A * 10/1990 Lin ..... A63H 13/00 428/3
5,442,869 A * 8/1995 McDarren ..... G09F 19/08 40/406
6,318,010 B1 * 11/2001 Tsai ..... G09F 19/08 40/406
6,464,078 B1 * 10/2002 Grossnickle ..... B43M 99/00 206/214
7,065,908 B1 * 6/2006 Pineda-Sanchez ..... G09F 19/02 40/406
D839,463 S * 1/2019 Fu ..... F21L 4/00 D26/94
11,079,083 B1 * 8/2021 Yang ..... G09F 13/34
11,175,032 B1 * 11/2021 Yang ..... F21V 33/0004
12,033,537 B1 * 7/2024 Hu ..... G09F 19/02
2003/0005608 A1 * 1/2003 Hsueh ..... G09F 19/02 40/406
2003/0089006 A1 * 5/2003 Lee ..... G09F 19/02 40/426
2012/0318809 A1 * 12/2012 Tsai ..... G09F 19/02 220/662
2014/0268663 A1 * 9/2014 Yang ..... F21S 10/002 362/101
2014/0268668 A1 * 9/2014 Yang ..... G09F 19/02 362/101
2016/0074768 A1 * 3/2016 Tsai ..... G09F 19/02 446/236
2023/0010070 A1 * 1/2023 Liu ..... G09F 19/02

* cited by examiner

*Primary Examiner* — Gary C Hoge

(57) ABSTRACT

A scene decoration article includes an outer housing, a cover part, and a driving device. The outer housing is provided with a first inner side wall and a first outer side wall. The first inner side wall surrounds and forms a first accommodating cavity. The first accommodating cavity is used for accommodating liquid. A surface of the first inner side wall is recessed to form an installation inner wall. The cover part is configured for covering the installation inner wall to form a water intake cavity between the cover part and the installation inner wall. The cover part is provided with a first water inlet. The installation inner wall is provided with a first water outlet. The first accommodating cavity, the first water inlet, the water intake cavity, and the first water outlet are in communication with each other.

20 Claims, 14 Drawing Sheets

SCENE DECORATION ARTICLE

CROSS-REFERENCE TO RELATED APPLICATIONS

The application claims priority of Chinese patent application CN2024231932073, filed on Dec. 20, 2024, which is incorporated herein by reference in its entireties.

TECHNICAL FIELD

The present invention relates to the field of scene decoration, particularly to a scene decoration article.

BACKGROUND ART

For the scene decoration articles currently on the market, such as decorative crystal balls currently on the market, it is necessary to fill the balls with water to decorate the balls. However, the water injected into the balls is usually static water, resulting in poor decorative effects. Therefore, there is an urgent need on the market to provide a scene decoration article with better decorative effects to enhance the user experience.

SUMMARY

In order to overcome the shortcomings of the prior art, a scene decoration article is provided in the present invention, including:

an outer housing, wherein the outer housing is provided with a first inner side wall and a first outer side wall; the first inner side wall surrounds and forms a first accommodating cavity;

the first accommodating cavity is used for accommodating liquid; and a surface of the first inner side wall is recessed to form an installation inner wall;

a cover part, wherein the cover part is configured for covering the installation inner wall to form a water intake cavity between the cover part and the installation inner wall; the cover part is provided with a first water inlet; the installation inner wall is provided with a first water outlet; and the first accommodating cavity, the first water inlet, the water intake cavity, and the first water outlet are in communication with each other; and a driving device, wherein the driving device is used for pushing the liquid in the first accommodating cavity to flow through the first water inlet, the water intake cavity, and the first water outlet in sequence, and to be discharged into the first accommodating cavity through the first water outlet to form a circulating water flow.

As an improvement of the present invention, the cover part is configured for covering a top portion of the installation inner wall. The first water outlet is provided on a side portion of the installation inner wall.

As an improvement of the present invention, an installation opening is defined in a top portion of the installation inner wall. The cover part is configured for covering the installation opening, so that the water intake cavity is formed between the cover part and the installation inner wall.

As an improvement of the present invention, the scene decoration article further includes a flow guide channel. The flow guide channel is provided with a first end and a second end. The first end of the flow guide channel is in communication with the first water outlet, and the second end of the flow guide channel extends into the first accommodating cavity. The second end is provided with a second water outlet. The first accommodating cavity, the first water inlet, the water intake cavity, the first water outlet, the flow guide channel, and the second water outlet are in communication with each other. The driving device is used for pushing the liquid in the first accommodating cavity to flow through the first water inlet, the water intake cavity, and the first water outlet in sequence, and to be discharged into the first accommodating cavity through the first water outlet, the flow guide channel, and the second water outlet to form the circulating water flow.

As an improvement of the present invention, a surface of the first inner side wall is recessed to form a flow guide inner wall. The cover part extends to form a flow guide cover. The flow guide cover is configured for covering at least one part of the second water outlet, so that the flow guide channel is formed between the flow guide cover and the flow guide inner wall.

As an improvement of the present invention, the scene decoration article further includes a partition part. The partition part extends from the first end to the second end. The partition part divides the first water outlet into a first water outlet unit and a second water outlet unit. The partition part divides the flow guide channel into a first flow guide unit and a second flow guide unit. The partition part divides the second water outlet into a third water outlet unit and a fourth water outlet unit.

As an improvement of the present invention, the flow guide cover is configured for covering at least one part of the third water outlet unit and at least one part of the fourth water outlet unit, so that the flow guide channel is formed between the flow guide cover and the flow guide inner wall.

As an improvement of the present invention, the flow guide cover is in an annular sector shape.

As an improvement of the present invention, the flow guide inner wall and the installation inner wall are arranged to be mutually inclined to form an included angle. An inner diameter of the flow guide channel gradually decreases from a first end to a second end.

As an improvement of the present invention, a top portion of the installation inner wall is provided with a first installation groove. The cover part is provided with a first installation protrusion. A top portion of the flow guide inner wall is provided with a second installation groove. The flow guide cover is provided with a second installation protrusion. The first installation protrusion is detachably connected to the first installation groove, and the second installation protrusion is detachably connected to the second installation groove.

As an improvement of the present invention, the first installation groove is in communication with the second installation groove, and the first installation protrusion is connected to the second installation protrusion.

As an improvement of the present invention, the driving device includes a driving motor, a first magnetic attraction member, and a second magnetic attraction member. The second magnetic attraction member is positioned inside the water intake cavity. The driving motor is provided with a driving output shaft. The first magnetic attraction member is sleeved on the driving output shaft. When the first magnetic attraction member rotates with the driving output shaft, the first magnetic attraction member drives the second magnetic attraction member arranged in the water intake cavity to rotate, so that the second magnetic attraction member pushes water in the water intake cavity and the first accommodating cavity to flow.

As an improvement of the present invention, a positioning column is configured for extending from an inner wall of the water intake cavity. A first installation hole is defined in the second magnetic attraction member. The second magnetic attraction member is rotatably sleeved on the positioning column through the first installation hole, so that the second magnetic attraction member is rotatable around an axis of the positioning column.

As an improvement of the present invention, a plurality of fan blades are configured for extending from an outer surface of the second magnetic attraction member. The second magnetic attraction member includes a bottom housing and an upper housing. The upper housing is connected to the bottom housing. A second accommodating cavity is formed between the upper housing and the bottom housing. A plurality of first magnetic attraction blocks are arranged inside the second accommodating cavity.

As an improvement of the present invention, a plurality of annular protrusions are configured for extending from an inner wall of the second accommodating cavity. The annular protrusion surrounds and forms a first position limiting groove. The first magnetic attraction block is positioned within the first position limiting groove.

As an improvement of the present invention, an installation portion is configured for extending from a surface of the first outer side wall. The driving motor is connected to the installation portion. The first magnetic attraction member, which is sleeved on the driving output shaft of the driving motor, is oriented towards the second magnetic attraction member, so that the first magnetic attraction member is capable of driving the second magnetic attraction member positioned inside the water intake cavity to rotate, thus allowing the second magnetic attraction member to push the water in the water intake cavity and the first accommodating cavity to flow.

As an improvement of the present invention, the driving device is a brushless driving device. The brushless driving device includes a stator winding part, a permanent magnet rotor part, a driver, and a position detection device. The permanent magnet rotor part is positioned inside the water intake cavity. The position detection device is used for detecting a position of the permanent magnet rotor part. The driver is used for sequentially energizing the stator winding part according to the position of the permanent magnet rotor part in a specific order, so that a magnetic field of the stator winding part always maintains an angular difference with a magnetic field of the permanent magnet rotor part, thereby generating continuous torque to push the permanent magnet rotor part to rotate, thus making the permanent magnet rotor part rotate to push water in the water intake cavity and the first accommodating cavity to flow.

As an improvement of the present invention, a positioning column is configured for extending from an inner wall of the water intake cavity. The permanent magnet rotor part is provided with a first installation hole. The permanent magnet rotor part is rotatably sleeved on the positioning column through the first installation hole, so that the permanent magnet rotor part is rotatable around an axis of the positioning column.

As an improvement of the present invention, the permanent magnet rotor part includes a connecting housing and a permanent magnet. The permanent magnet is connected to the connecting housing. An outer surface of the connecting housing is connected to a plurality of fan blades.

As an improvement of the present invention, the first accommodating cavity is provided with a first accommodating opening. The scene decoration article further includes an inner container. The inner container is provided with a second inner side wall and a second outer side wall. The inner container is placed into the first accommodating cavity through the first accommodating opening. An accommodating gap is defined between the second outer side wall of the inner container and the first inner side wall of the outer housing. The accommodating gap is used for accommodating liquid. The driving device is used for pushing water in the accommodating gap and the water intake cavity to flow.

As an improvement of the present invention, the outer housing is a transparent outer housing, and the inner container is a transparent inner container. A bottom portion of the inner container is provided with support feet. When the inner container is placed in the first accommodating cavity, the support feet are configured for supporting on a bottom portion of the first inner side wall.

As an improvement of the present invention, the scene decoration article further includes an installation housing and a support base. The installation housing is connected to the support base. A third accommodating cavity is defined in the installation housing. A third accommodating opening is defined in a lower side of the installation housing. A fourth accommodating opening is defined in an upper side of the installation housing. The third accommodating opening and the fourth accommodating opening are both in communication with the third accommodating cavity. The outer housing is placed in the third accommodating cavity through the third accommodating opening. The support base is used for supporting a bottom portion of the outer housing.

As an improvement of the present invention, an upper side of the inner container extends to form a covering portion. The first accommodating opening is in communication with the first accommodating cavity. The inner container is placed into the first accommodating cavity through the first accommodating opening. The upper side of the inner container is connected to an upper side of the outer housing through the covering portion, so that the covering portion seals and covers the accommodating gap. The outer housing is equipped with a positioning convex block. A positioning groove is defined in the covering portion. The positioning convex block is connected to the positioning groove in an embedded manner.

As an improvement of the present invention, the second accommodating opening is in communication with the fourth accommodating cavity. The fourth accommodating cavity is surrounded and formed by the second inner side wall. The fourth accommodating cavity is used for accommodating a decorative item.

Beneficial effects of the present invention are as follows. The scene decoration article is provided in the present invention. The scene decoration article includes the outer housing, the cover part, and the driving device. The outer housing is provided with a first inner side wall and a first outer side wall. The first inner side wall surrounds and forms the first accommodating cavity. The first accommodating cavity is used for accommodating liquid. The surface of the first inner side wall is recessed to form an installation inner wall. The cover part is configured for covering the installation inner wall to form the water intake cavity between the cover part and the installation inner wall. The cover part is provided with the first water inlet, and the installation inner wall is provided with the first water outlet. The first accommodating cavity, the first water inlet, the water intake cavity, and the first water outlet are in communication with each other. The driving device is used for pushing the liquid in the first accommodating cavity to flow through the first water inlet, the water intake cavity, and the first water outlet in sequence, and to be discharged into the first accommodating cavity through the first water outlet to form the circulating water flow. Therefore, the driving device is capable of driving the liquid in the first accommodating cavity to flow through the first water inlet, the water intake cavity, and the first water outlet in sequence, and to be discharged into the first accommodating cavity through the first water outlet to form an effect of the circulating water flow, which has a better effect in decorating a scene and a higher ornamental value compared with static water. Moreover, due to the presence of the water intake cavity, the driving device can effectively improve the efficiency of the circulation of the water flow and further enhance the decorative effect by driving the water in the water intake cavity to flow.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
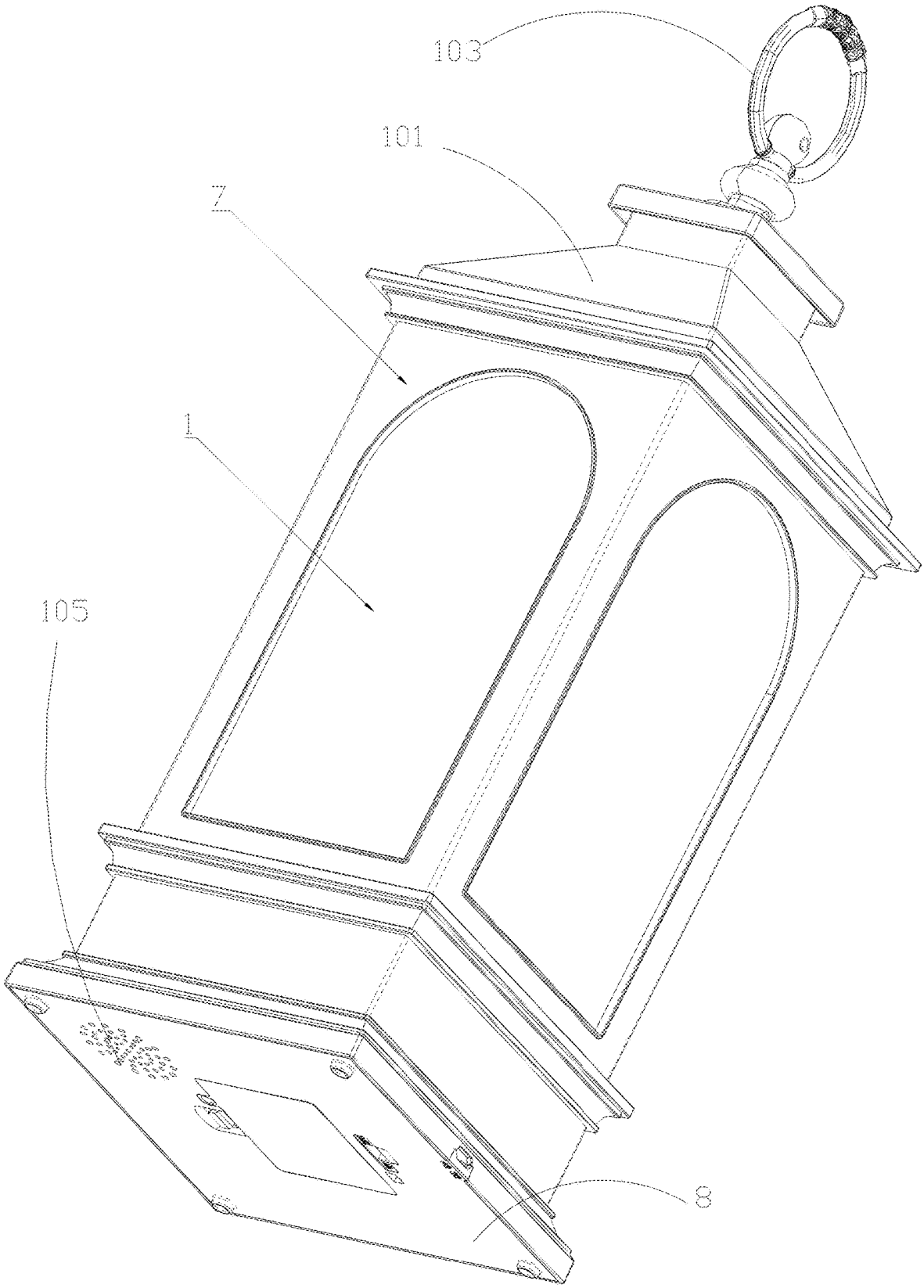
FIG. 1 is a schematic diagram of an overall structure of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
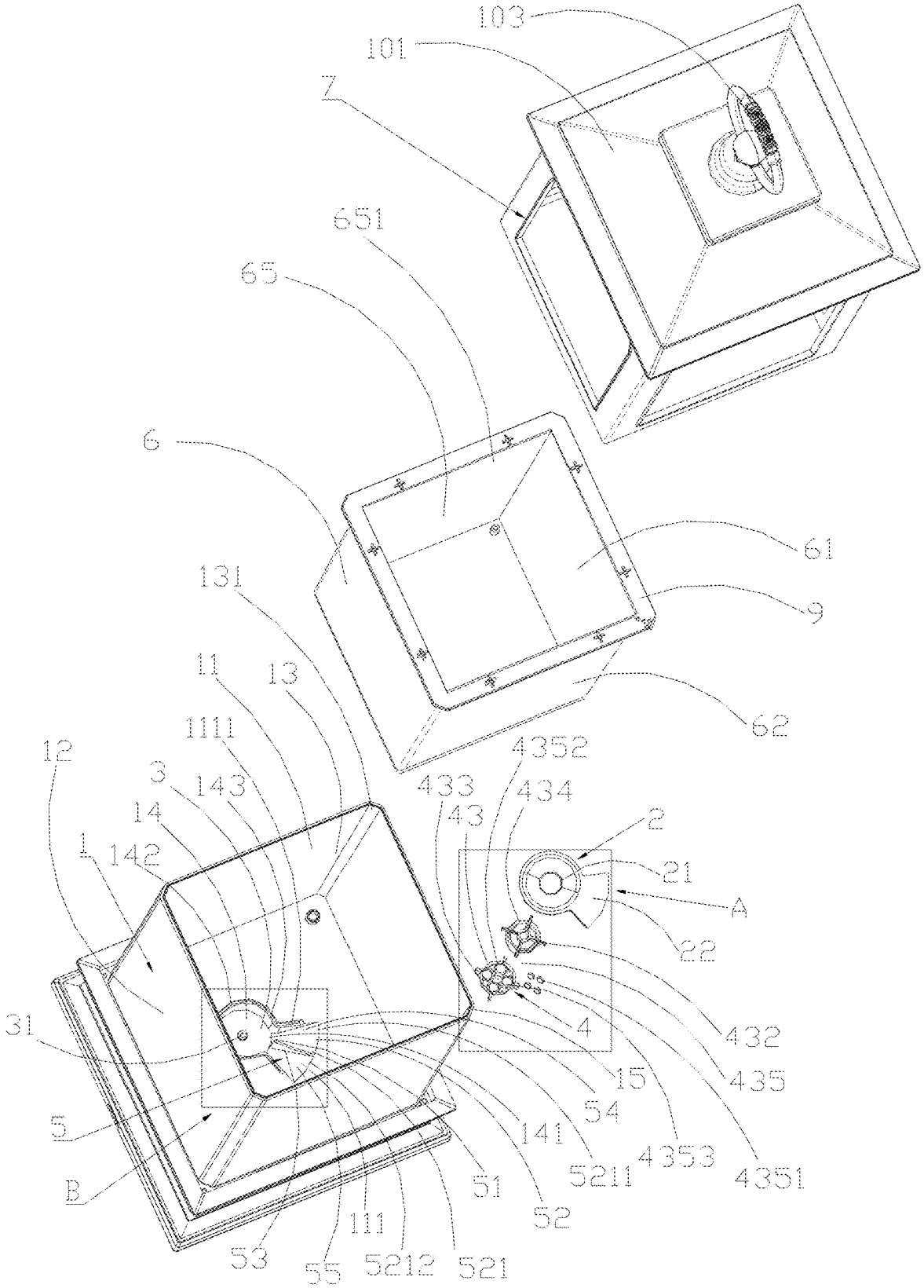
FIG. 2 is an exploded view of the present invention.
Figure 3:
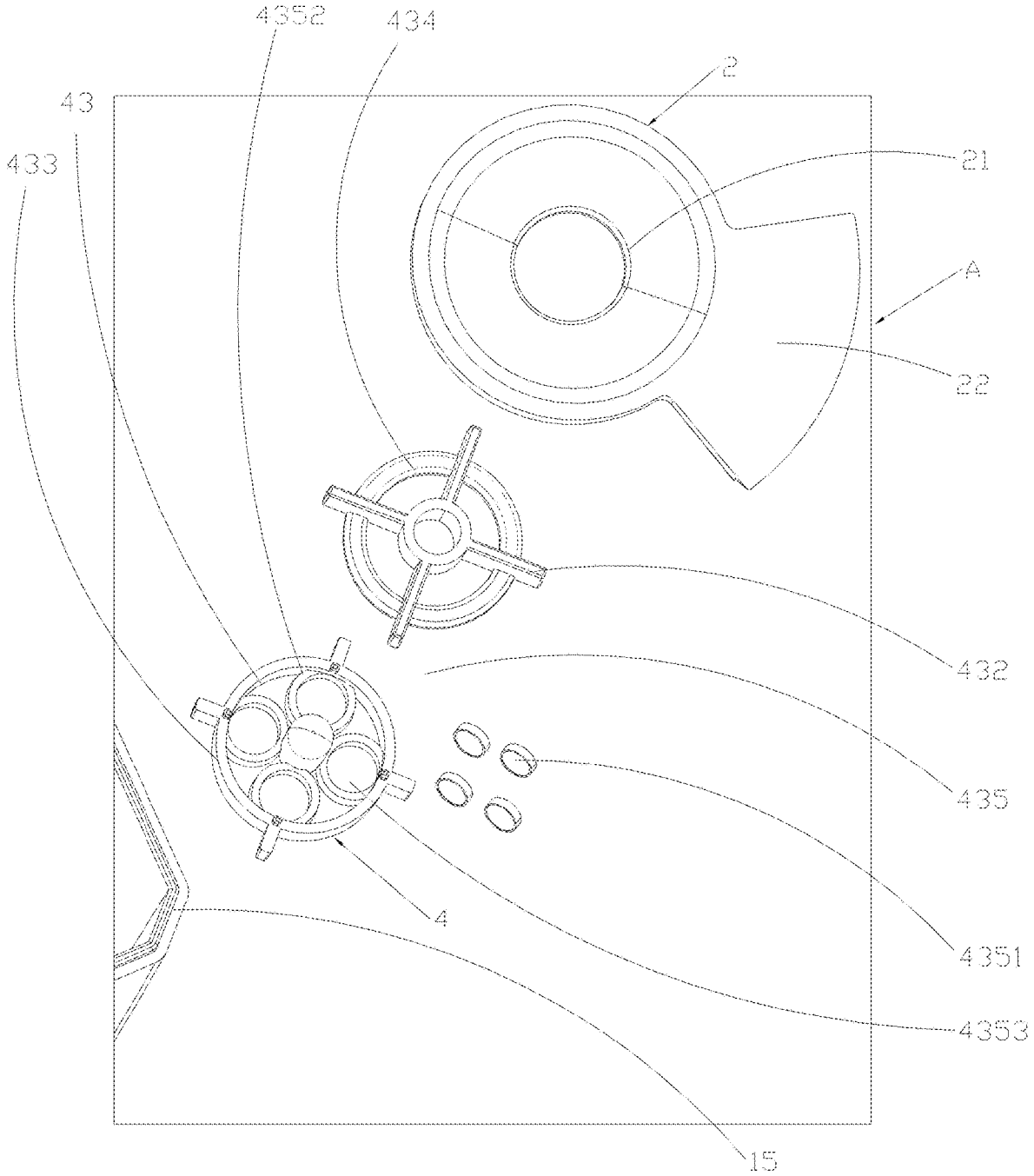
FIG. 3 is an enlarged view of area A in FIG. 2.
Figure 4:
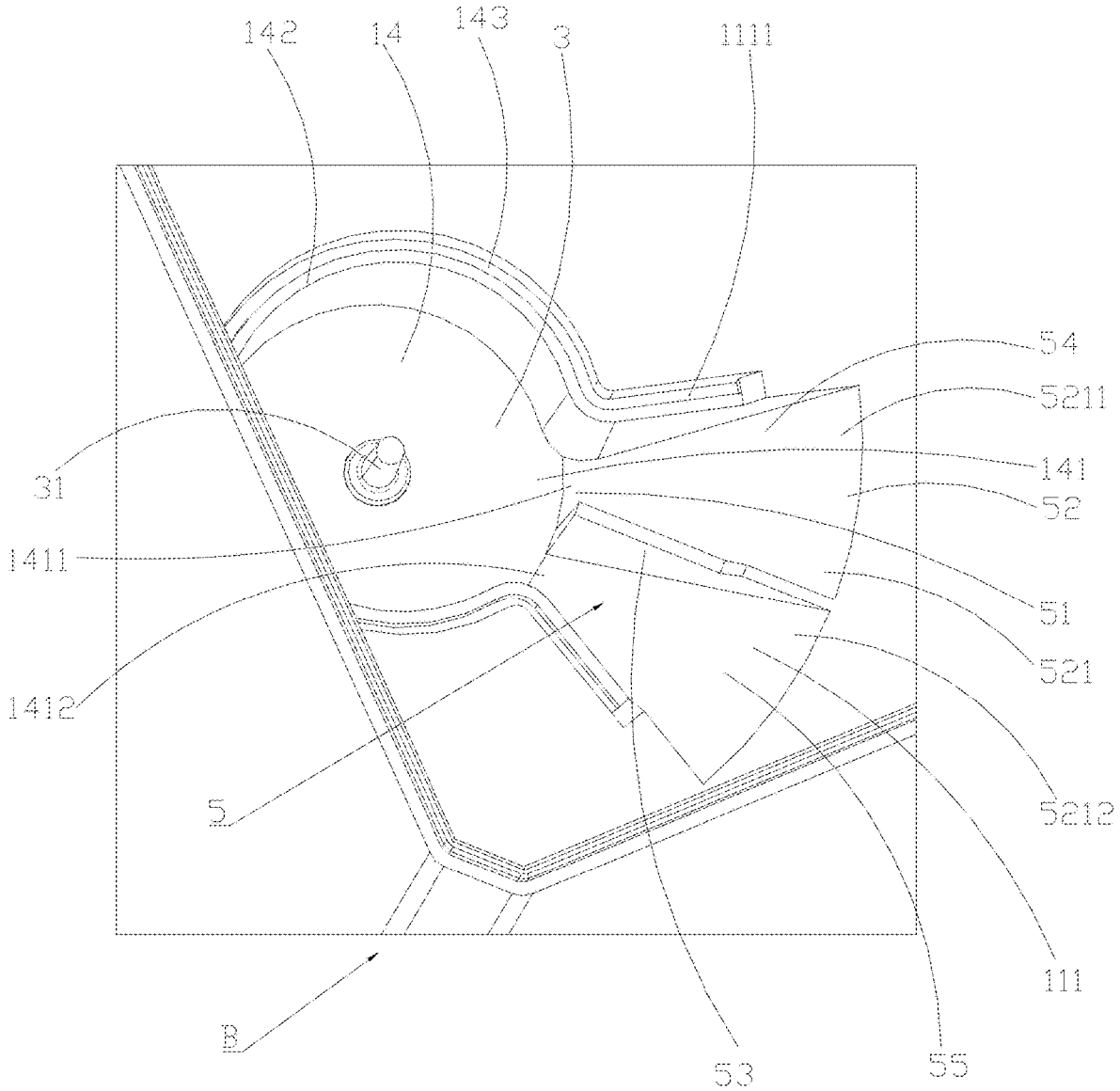
FIG. 4 is an enlarged view of area B in FIG. 2.
Figure 5:
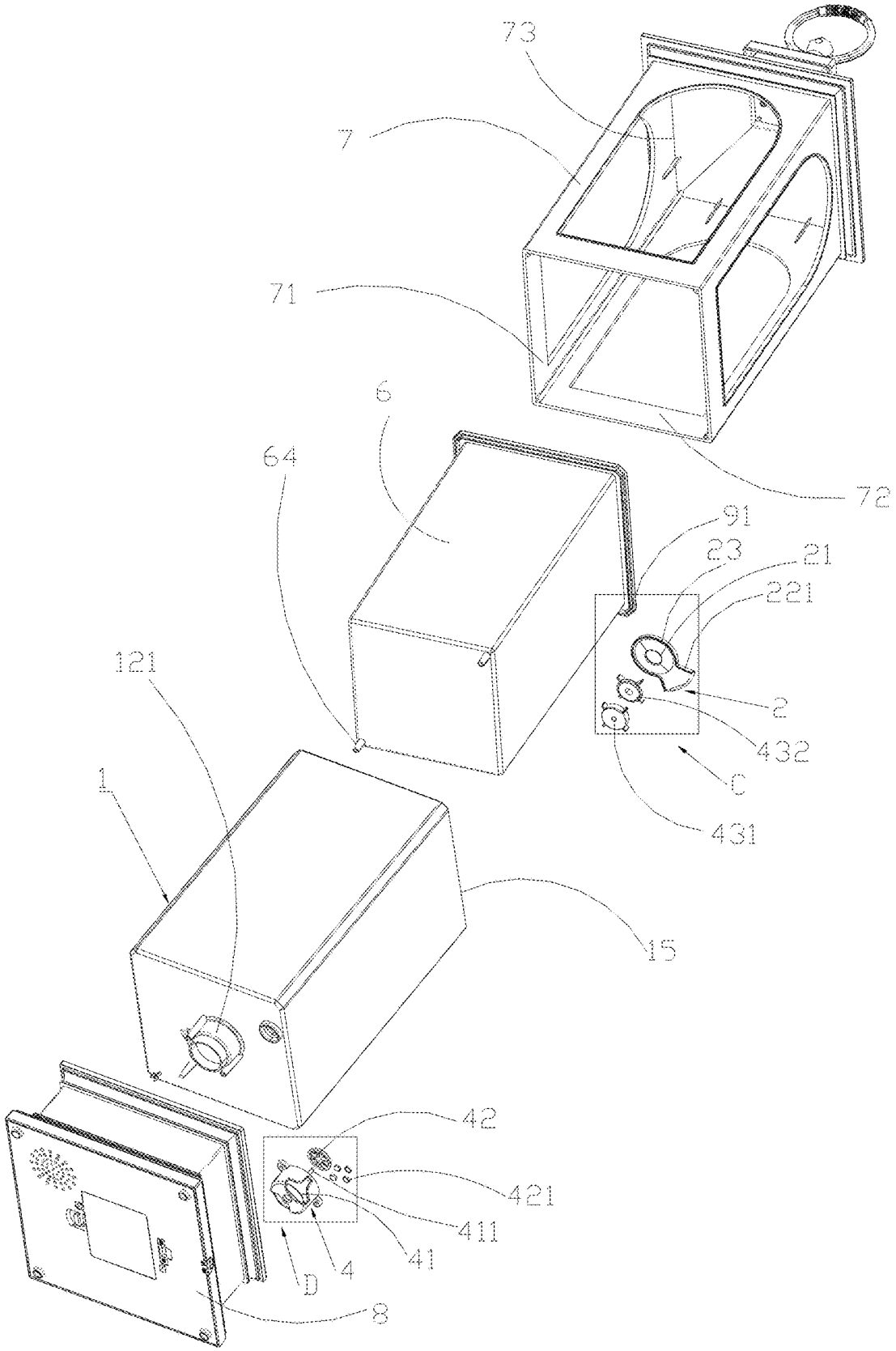
FIG. 5 is another exploded view of the present invention.
Figure 6:
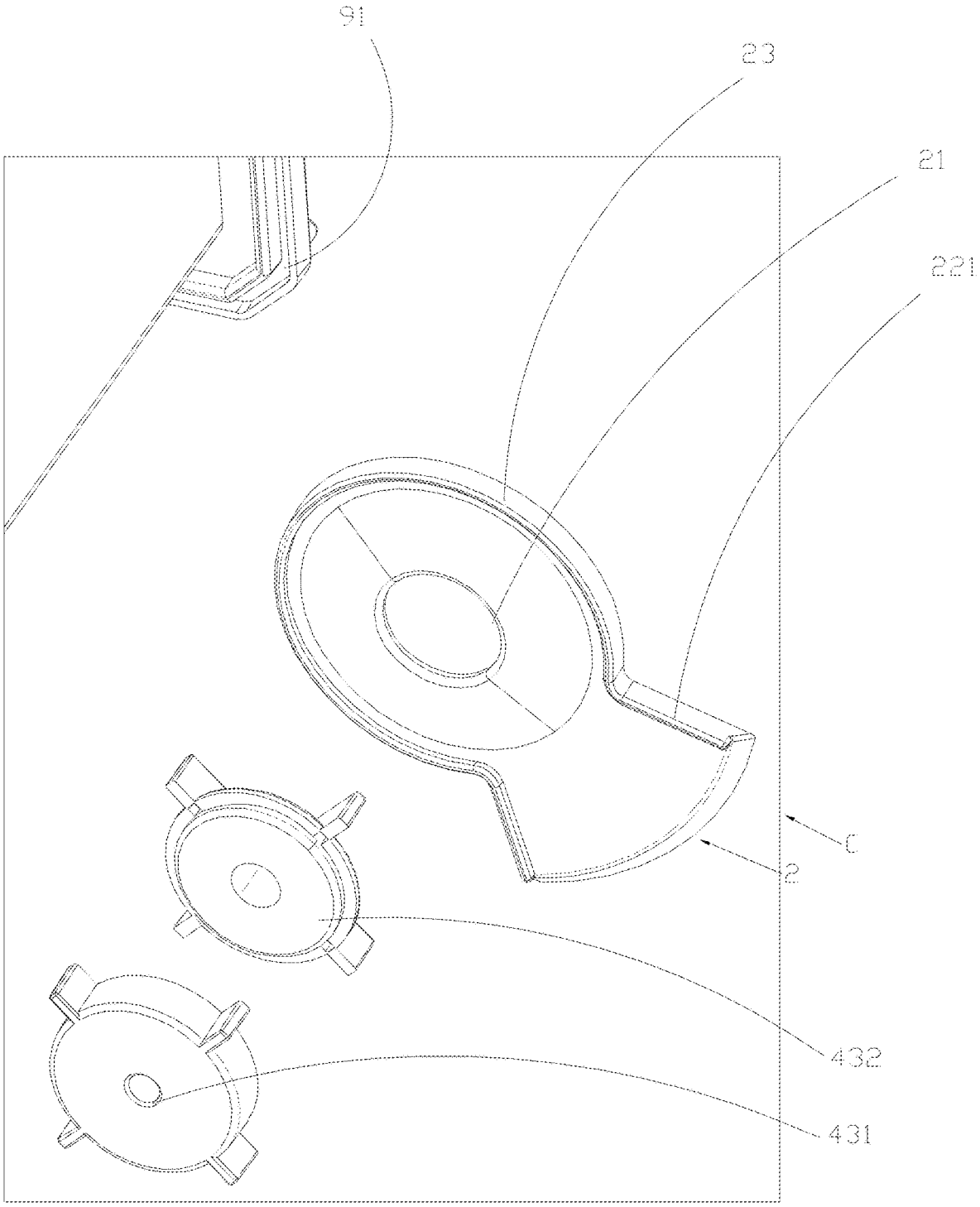
FIG. 6 is an enlarged view of area C in FIG. 5.
Figure 7:
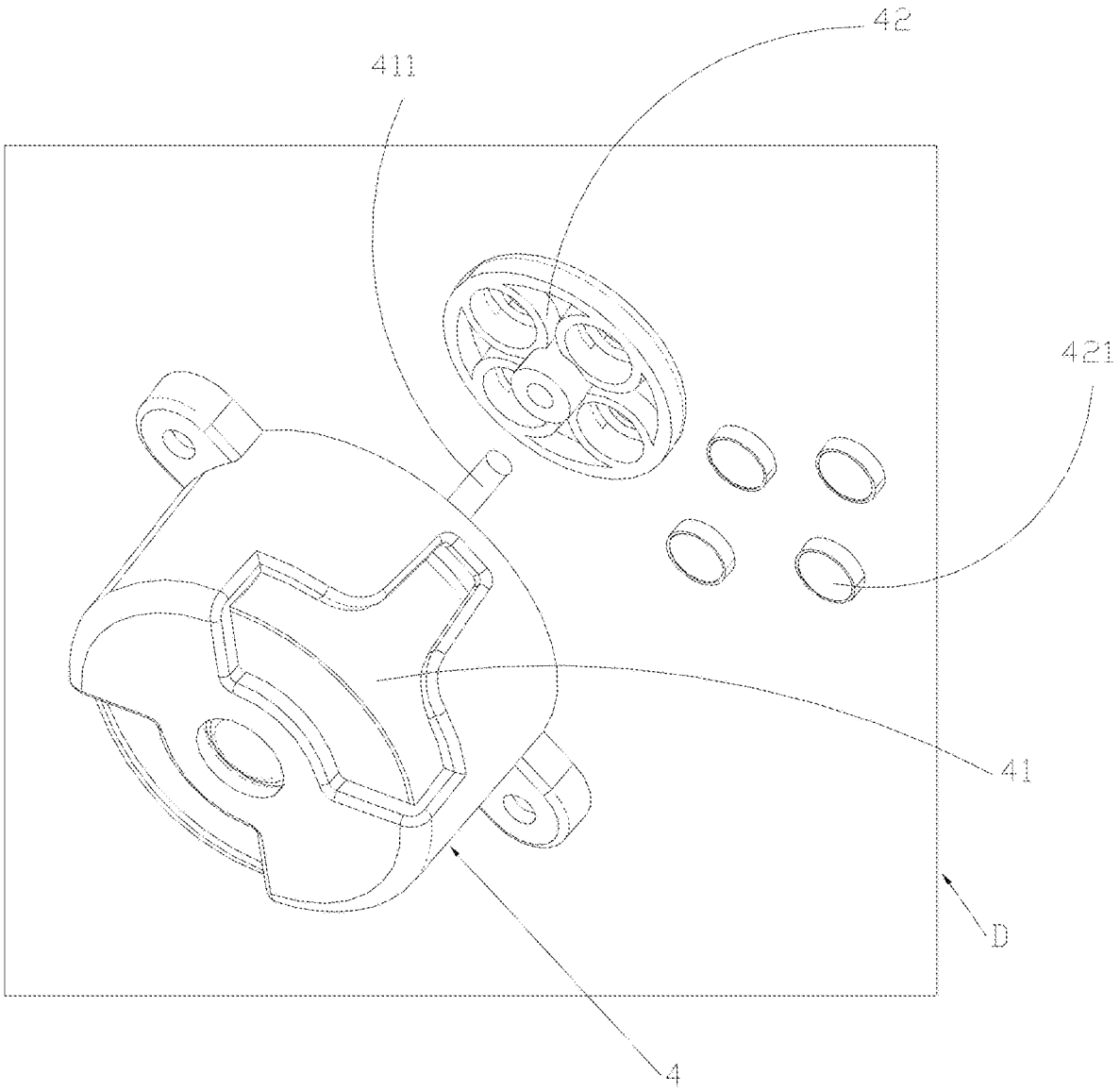
FIG. 7 is an enlarged view of area D in FIG. 5.
Figure 8:
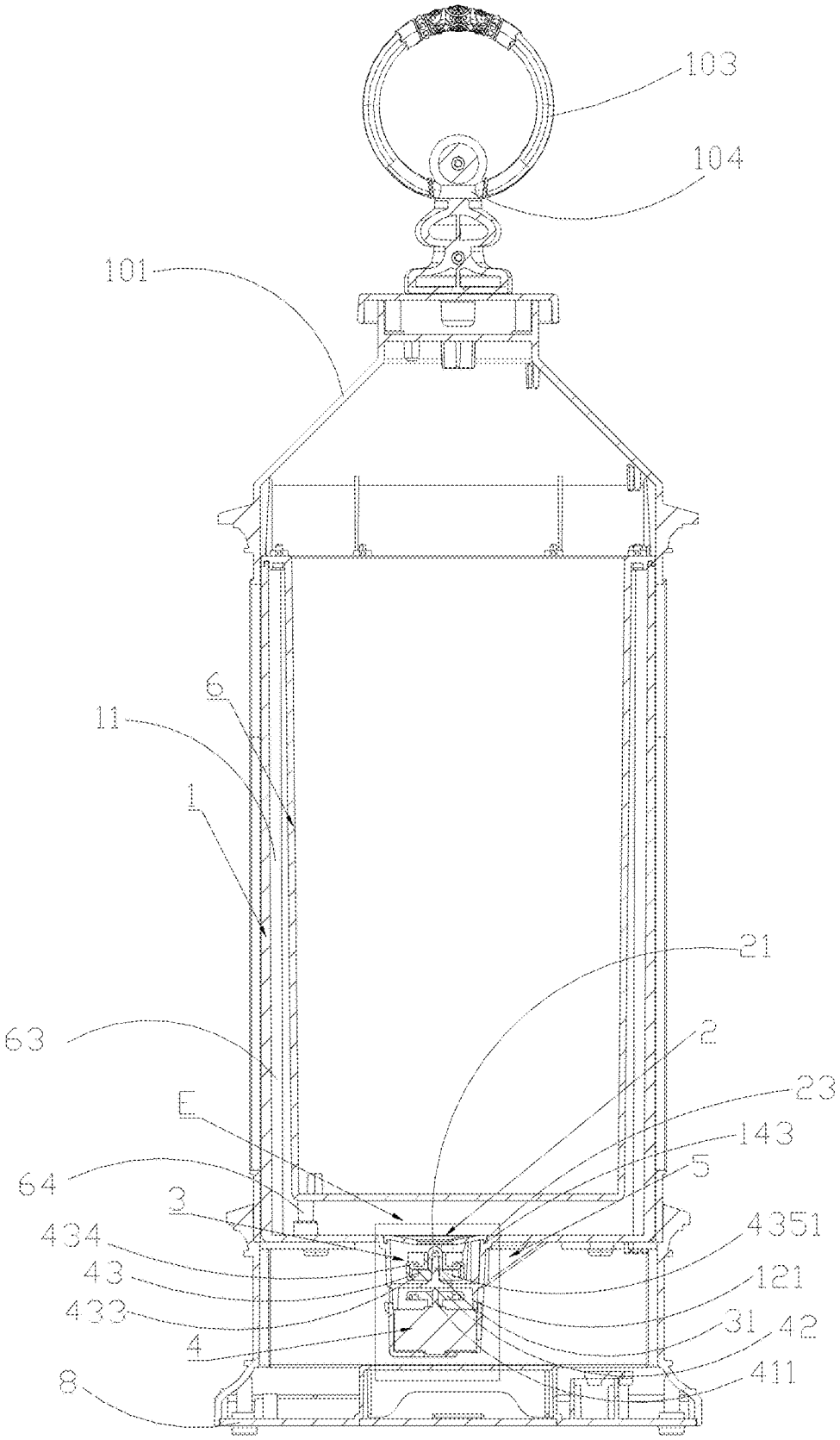
FIG. 8 is a sectional view taken along a driving motor.
Figure 9:
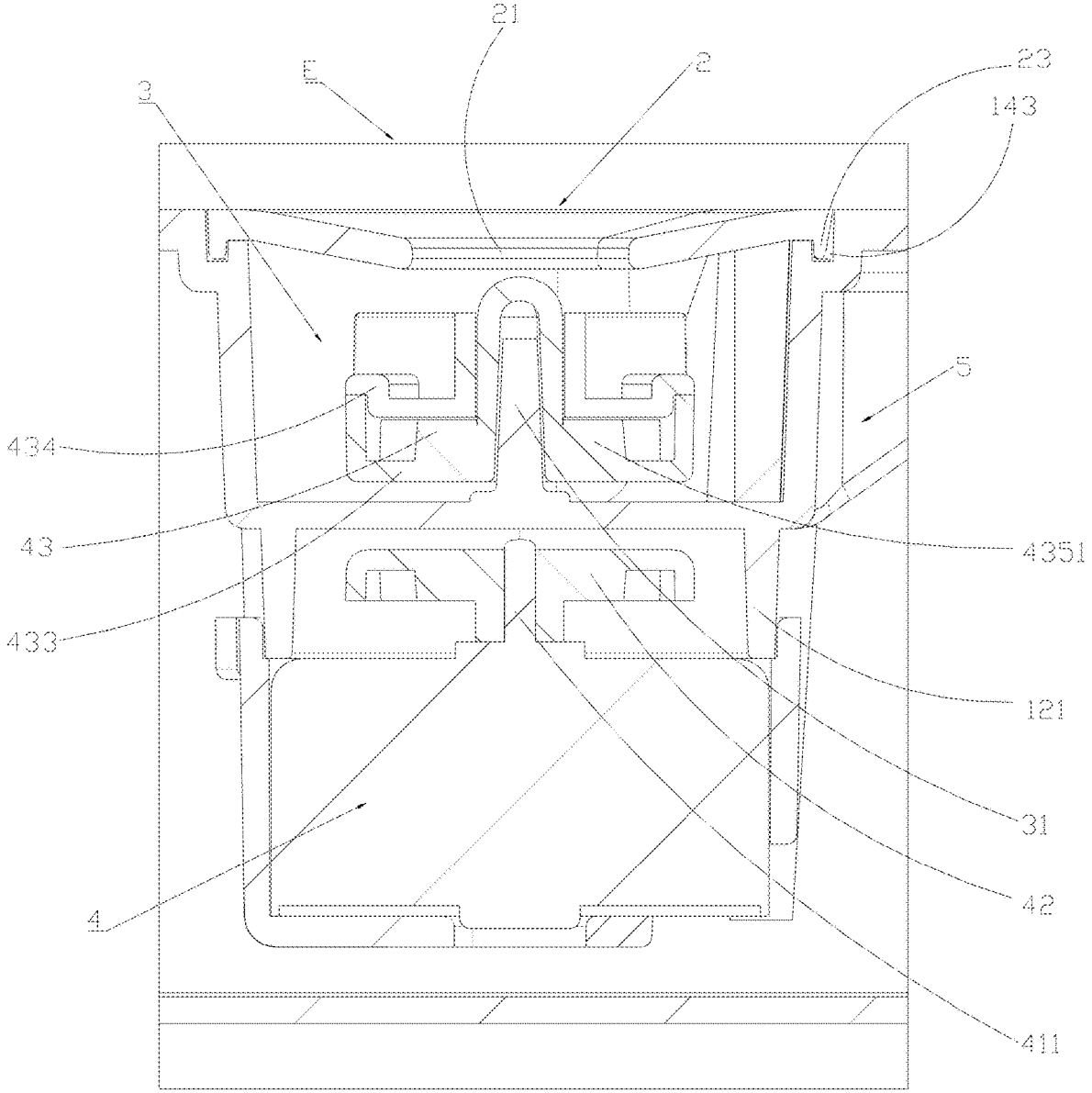
FIG. 9 is an enlarged view of area E in FIG. 8.
Figure 10:
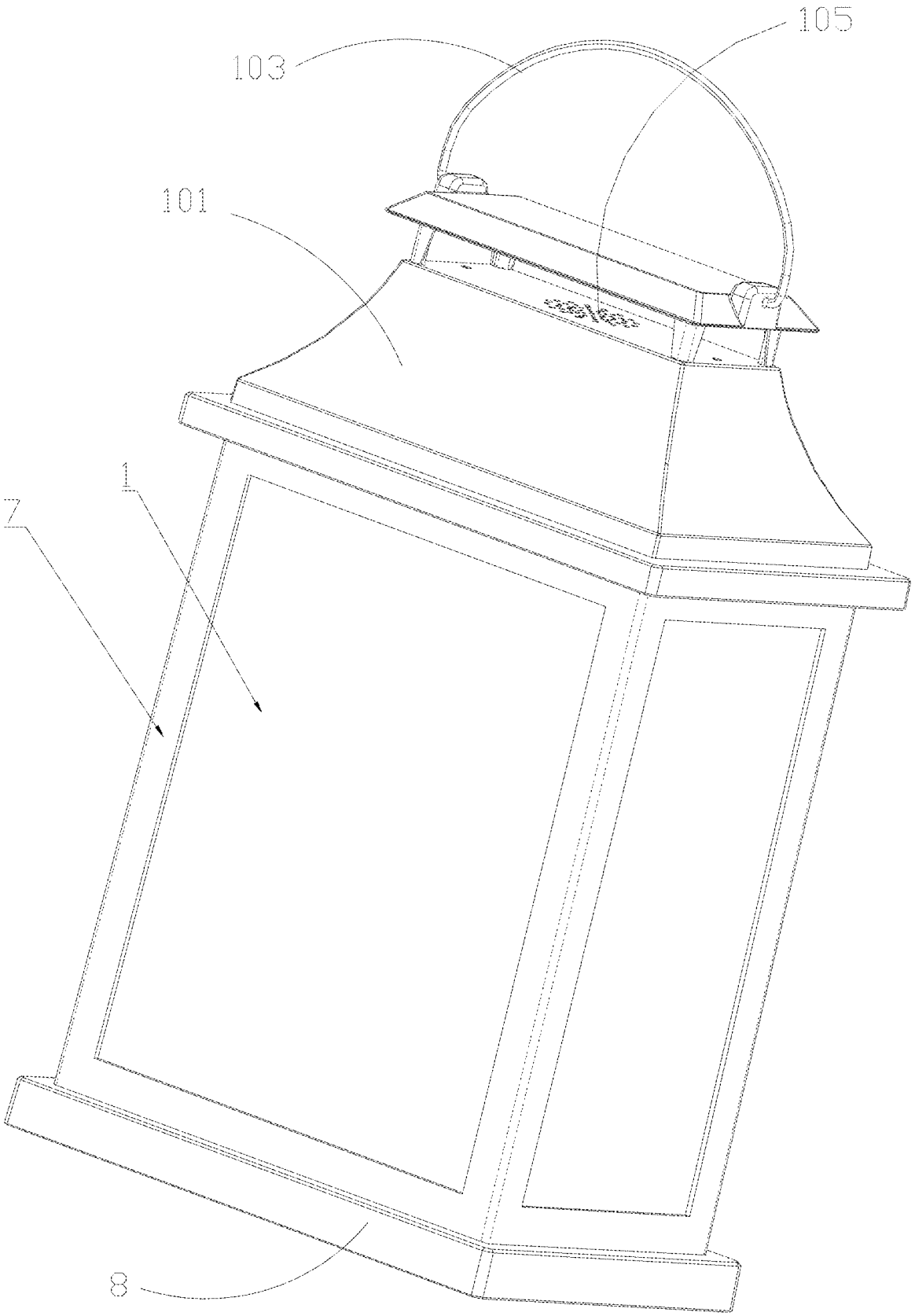
FIG. 10 is another schematic diagram of an overall structure of the present invention.
Figure 11:
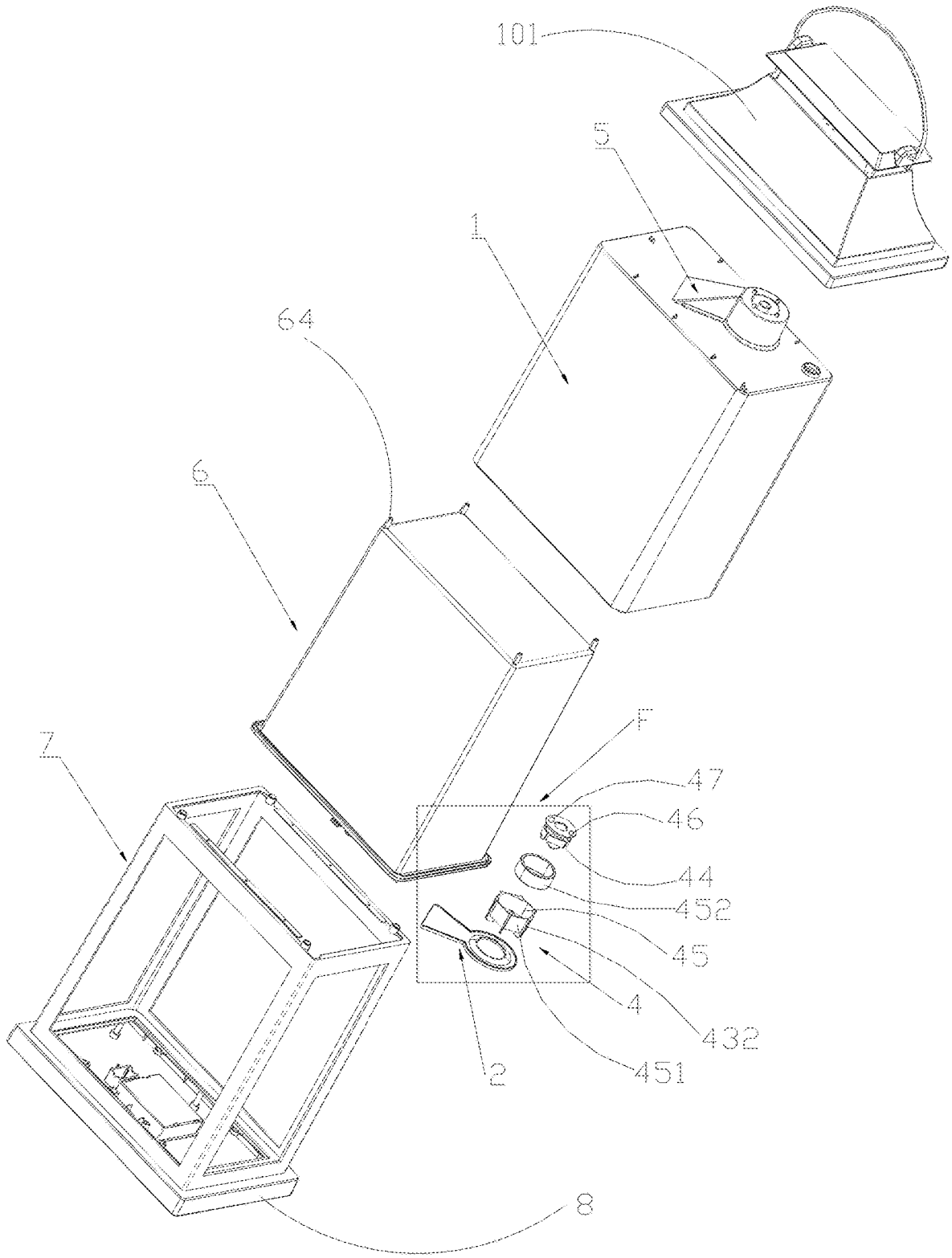
FIG. 11 is another exploded view of the present invention.
Figure 12:
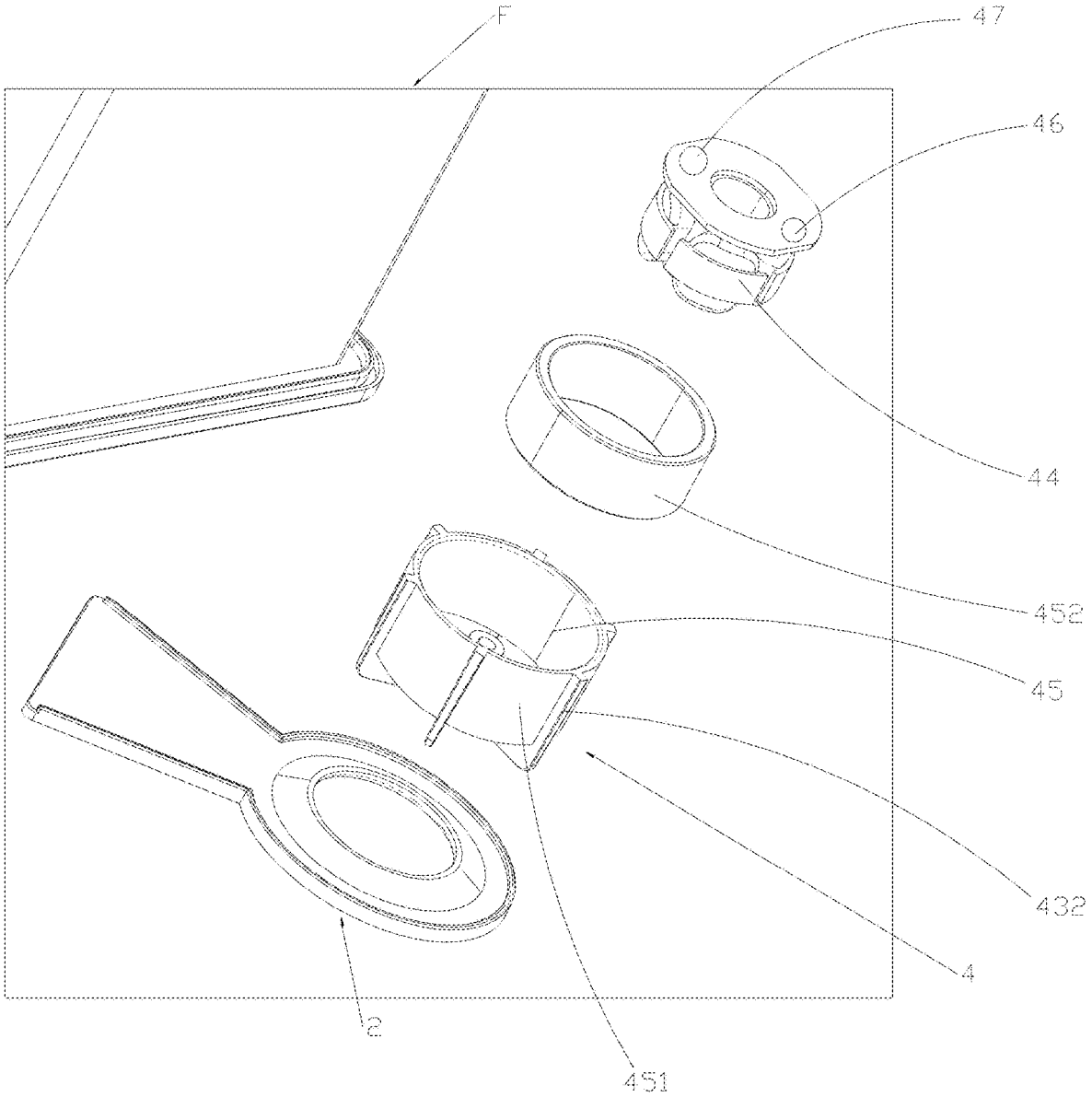
FIG. 12 is an enlarged view of area F in FIG. 11.
Figure 13:
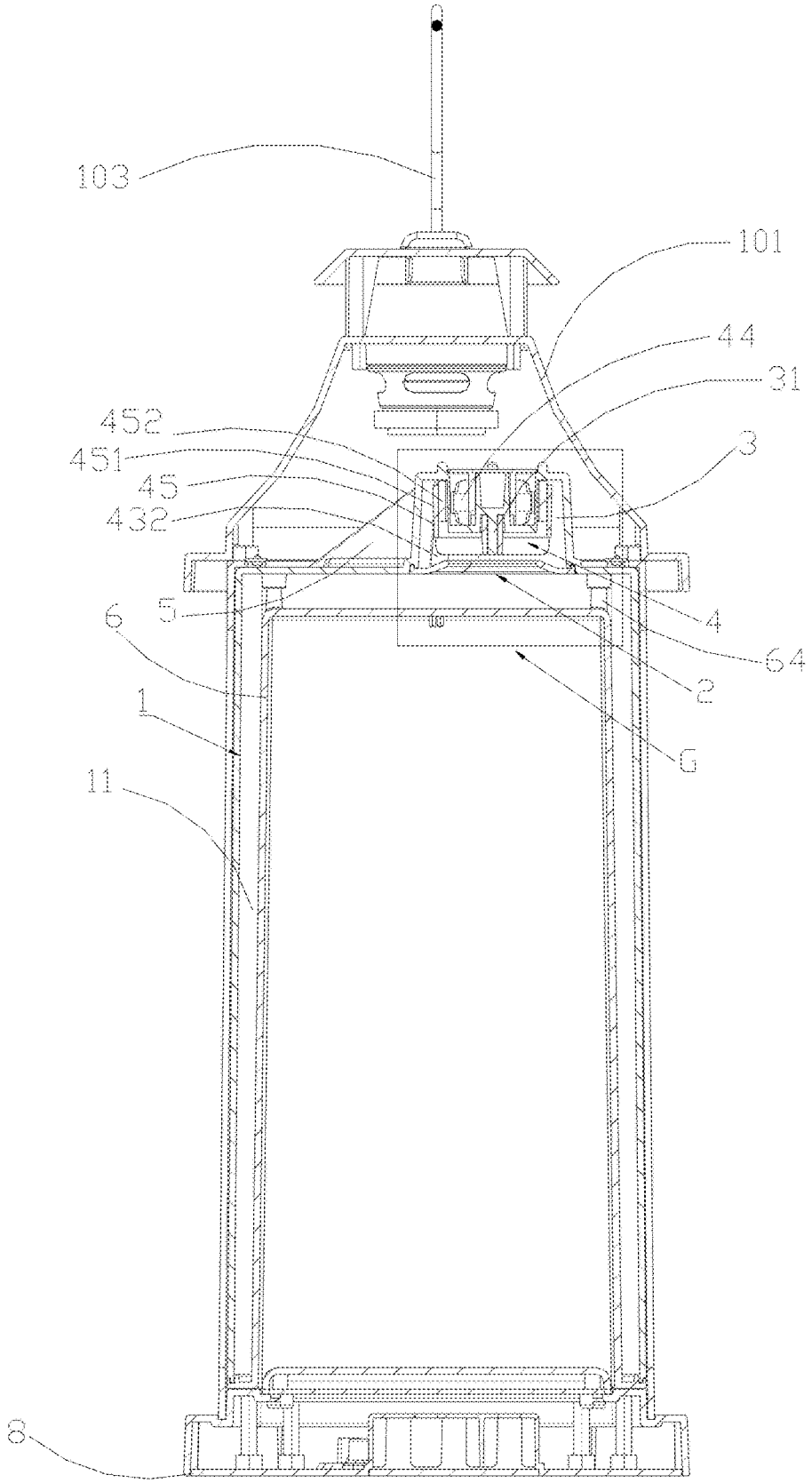
FIG. 13 is a sectional view taken along a brushless driving device.
Figure 14:
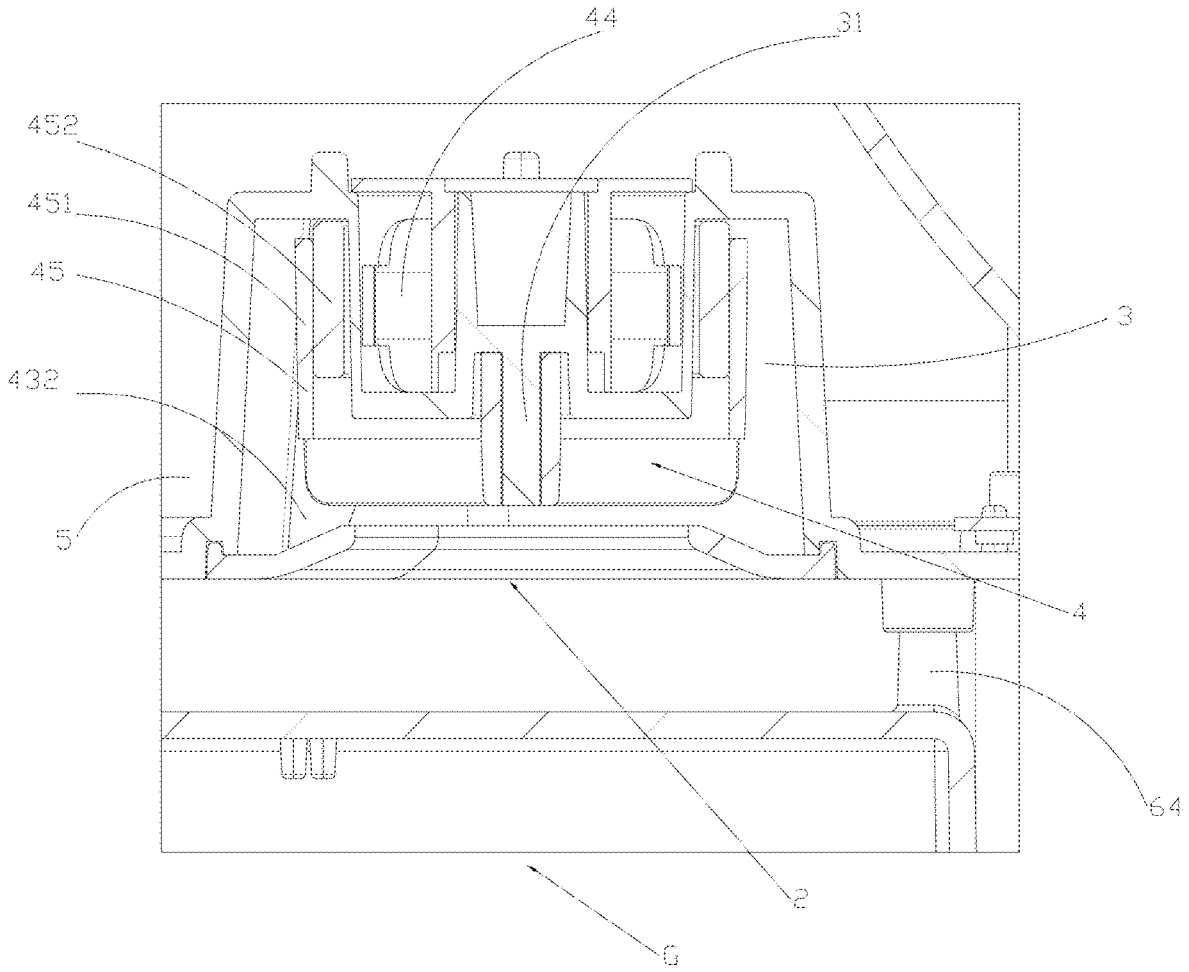
FIG. 14 is an enlarged view of area G in FIG. 13.

Referring to FIGS. 1-14, a scene decoration article includes:

- an outer housing 1, wherein the outer housing 1 is provided with a first inner side wall 11 and a first outer side wall 12; the first inner side wall 11 surrounds and forms a first accommodating cavity 13; the first accommodating cavity 13 is used for accommodating liquid; and a surface of the first inner side wall 11 is recessed to form an installation inner wall 14;
- a cover part 2, wherein the cover part 2 is configured for covering the installation inner wall 14, so that a water intake cavity 3 is formed between the cover part 2 and the installation inner wall 14; the cover part 2 is provided with a first water inlet 21; the installation inner wall 14 is provided with a first water outlet 141; and the first accommodating cavity 13, the first water inlet 21, the water intake cavity 3, and the first water outlet 141 are in communication with each other; and
- a driving device 4, wherein the driving device 4 is used for pushing the liquid in the first accommodating cavity 13 to flow through the first water inlet 21, the water intake cavity 3, and the first water outlet 141 in sequence, and to be discharged into the first accommodating cavity 13 through the first water outlet 141 to form a circulating water flow.

Through the above structure, the scene decoration article includes the outer housing 1, the cover part 2, and the driving device 4. The outer housing 1 is provided with the first inner side wall 11 and the first outer side wall 12. The first inner side wall 11 surrounds and forms the first accommodating cavity 13. The first accommodating cavity 13 is used for accommodating liquid. The surface of the first inner side wall 11 is recessed to form the installation inner wall 14. The cover part 2 is configured for covering the installation inner wall 14, so that the water intake cavity 3 is formed between the cover part 2 and the installation inner wall 14. The cover part 2 is provided with the first water inlet 21, and the installation inner wall 14 is provided with the first water outlet 141. The first accommodating cavity 13, the first water inlet 21, the water intake cavity 3, and the first water outlet 141 are in communication with each other. The driving device 4 is used for pushing the liquid in the first accommodating cavity 13 to flow through the first water inlet 21, the water intake cavity 3, and the first water outlet 141 in sequence, and to be discharged into the first accommodating cavity 13 through the first water outlet 141 to form the circulating water flow. Therefore, the driving device 4 is capable of driving the liquid in the first accommodating cavity 13 to flow through the first water inlet 21, the water intake cavity 3, and the first water outlet 141 in sequence, and to be discharged into the first accommodating cavity 13 through the first water outlet 141 to form an effect of the circulating water flow, which has a better effect in decorating a scene and a higher ornamental value compared with static water. Moreover, due to the provision of the water intake cavity 3, the driving device 4 can effectively improve the efficiency of the circulation of the water flow and further enhance a decorative effect by driving the water in the water intake cavity 3 to flow.

A volume of the water intake cavity 3 is smaller than a volume of the first accommodating cavity 13. Specifically, the volume of the first accommodating cavity 13 is 2-10000 times the volume of the water intake cavity 3.

In this embodiment, the cover part 2 is configured for covering a top portion of the installation inner wall 14. The first water outlet 141 is provided on a side portion of the installation inner wall 14. The cover part 2 is configured for detachably covering the top portion of the installation inner wall 14, or the cover part 2 is integrally formed and connected with the installation inner wall 14. Through the above structure, the driving device 4 drives the liquid to flow from the first water inlet 21 of the cover part 2 positioned at the top portion into the water intake cavity 3, and to flow out from the first water outlet 141 provided on the side portion of the installation inner wall 14, thereby changing a flow direction of the liquid and greatly improving the efficiency of the circulation of the water flow, further enhancing the decorative effect.

In this embodiment, an installation opening 142 is defined in a top portion of the installation inner wall 14. The cover part 2 is configured for covering the installation opening 142, so that the water intake cavity 3 is formed between the cover part 2 and the installation inner wall 14. Through the above structure, the arrangement of the water intake cavity 3 is effectively achieved, making it easy for a user to install and remove the cover part 2.

In this embodiment, the scene decoration article further includes a flow guide channel 5. The flow guide channel 5 is provided with a first end 51 and a second end 52. The first end 51 of the flow guide channel 5 is in communication with the first water outlet 141, and the second end 52 of the flow guide channel 5 extends into the first accommodating cavity 13. The second end 52 is provided with a second water outlet 521. The first accommodating cavity 13, the first water inlet 21, the water intake cavity 3, the first water outlet 141, the flow guide channel 5, and the second water outlet 521 are in communication with each other. The driving device 4 is used for pushing the liquid in the first accommodating cavity 13 to flow through the first water inlet 21, the water intake cavity 3, and the first water outlet 141 in sequence, and to be discharged into the first accommodating cavity 13 through the first water outlet 141, the flow guide channel 5, and the second water outlet 521 to form the circulating water flow. A surface of the first inner side wall 11 is recessed to form a flow guide inner wall 111. The cover part 2 extends to form a flow guide cover 22. The flow guide cover 22 is configured for covering at least one part of the second water outlet 521, so that the flow guide channel 5 is formed between the flow guide cover 22 and the flow guide inner wall 111. Through the above structure, the flow guide cover 22 is configured for covering at least one part of the second water outlet 521, reducing a diameter of the second water outlet 521 to increase a flow velocity of the water flowing out and improve the efficiency of the circulation of the water flow, further enhancing the decorative effect.

In this embodiment, the scene decoration article further includes a partition part 53. The partition part 53 extends from the first end 51 to the second end 52. The partition part 53 divides the first water outlet 141 into a first water outlet unit 1411 and a second water outlet unit 1412. The partition part 53 divides the flow guide channel 5 into a first flow guide unit 54 and a second flow guide unit 55. The partition part 53 divides the second water outlet 521 into a third water outlet unit 5211 and a fourth water outlet unit 5212. The flow guide cover 22 is configured for covering at least one part of the third water outlet unit 5211 and at least one part of the fourth water outlet unit 5212, so that the flow guide channel 5 is formed between the flow guide cover 22 and the flow guide inner wall 111. Specifically, the flow guide cover 22 is in an annular sector shape. Through the above structure, since the partition part 53 divides the second water outlet 521 into the third water outlet unit 5211 and the fourth water outlet unit 5212, and the flow guide cover 22 is configured for covering at least one part of the second water outlet 521, the diameter of the second water outlet 521 is reduced to increase the flow velocity of the water flowing out and improve the efficiency of the circulation of the water flow, further enhancing the decorative effect.

In this embodiment, the flow guide inner wall 111 and the installation inner wall 14 are arranged to be mutually inclined to form an included angle. An inner diameter of the flow guide channel 5 gradually decreases from the first end 51 to the second end 52. Through the above structure, since the inner diameter of the flow guide channel 5 gradually decreases from the first end 51 to the second end 52, the flow velocity of the water out of the water intake cavity 3 can be increased to improve the efficiency of the circulation of the water flow and further enhance the decorative effect.

In this embodiment, a top portion of the installation inner wall 14 is provided with a first installation groove 143. The cover part 2 is provided with a first installation protrusion 23. A top portion of the flow guide inner wall 111 is provided with a second installation groove 1111. The flow guide cover 22 is provided with a second installation protrusion 221. The first installation protrusion 23 is detachably connected to the first installation groove 143, and the second installation protrusion 221 is detachably connected to the second installation groove 1111. The first installation groove 143 is in communication with the second installation groove 1111, and the first installation protrusion 23 is connected to the second installation protrusion 221. Through the above structure, the installation of the cover part 2 and the flow guide cover 22 is effectively achieved. The flow guide cover 22 is integrally formed with the cover part 2. Alternatively, in other embodiments, the flow guide cover 22 can also be detachably connected to the cover part 2.

Referring to FIGS. 1-9, the driving device 4 includes a driving motor 41, a first magnetic attraction member 42, and a second magnetic attraction member 43. The second magnetic attraction member 43 is positioned inside the water intake cavity 3. The driving motor 41 is provided with a driving output shaft 411. The first magnetic attraction member 42 is sleeved on the driving output shaft 411. When the first magnetic attraction member 42 rotates with the driving output shaft 411, the first magnetic attraction member 42 drives the second magnetic attraction member 43 arranged in the water intake cavity 3 to rotate, so that the second magnetic attraction member 43 pushes the water in the water intake cavity 3 and the first accommodating cavity 13 to flow. A positioning column 31 is configured for extending form an inner wall of the water intake cavity 3. A first installation hole 431 is defined in the second magnetic attraction member 43. The second magnetic attraction member 43 is rotatably sleeved on the positioning column 31 through the first installation hole 431, so that the second magnetic attraction member 43 is rotatable around an axis of the positioning column 31. Specifically, a plurality of fan blades 432 are configured for extending from an outer surface of the second magnetic attraction member 43. The second magnetic attraction member 43 includes a bottom housing 433 and an upper housing 434. The upper housing 434 is connected to the bottom housing 433. A second accommodating cavity 435 is formed between the upper housing 434 and the bottom housing 433. A plurality of first magnetic attraction blocks 4351 are arranged inside the second accommodating cavity 435. Furthermore, a plurality of annular protrusions 4352 are configured for extending from an inner wall of the second accommodating cavity 435. The annular protrusion 4352 surrounds and forms a first position limiting groove 4353. The first magnetic attraction block 4351 is positioned within the first position limiting groove 4353. Furthermore, an installation portion 121 is configured for extending from a surface of the first outer side wall 12. The driving motor 41 is connected to the installation portion 121. The first magnetic attraction member 42, which is sleeved on the driving output shaft of the driving motor 41, is oriented towards the second magnetic attraction member 43, so that the first magnetic attraction member 42 is capable of driving the second magnetic attraction member 43 positioned inside the water intake cavity to rotate, thus allowing the second magnetic attraction member 43 to push the water in the water intake cavity and the first accommodating cavity to flow. Through the above structure, the arrangement of the driving device 4 is effectively achieved. Moreover, through the rotation of the first magnetic attraction member 42, the second magnetic attraction member 43 is driven to rotate, which can prevent the driving motor 41 and a motor output shaft from directly contacting with the water in an accommodating gap 63, effectively preventing water leakage and short circuit of the driving motor 41, and improving the service life and working stability of the driving motor 41. Furthermore, the first magnetic attraction member 42 is a magnetic ring, and the second magnetic attraction member 43 is in the shape of a fan blade. Moreover, the water intake cavity 3 can fix a position of the fan blade, making the fan blade work more stably and preventing the fan blade from dropping out. In addition, the second magnetic attraction member 43 inside the water intake cavity 3 is capable of changing a flow direction of the liquid by rotating, so as to improve the efficiency of the circulation of the water flow. The first magnetic attraction member is also provided with a plurality of second magnetic attraction blocks 421.

Referring to FIGS. 1-9, the driving device is positioned at a bottom portion of the outer housing. A support base is provided with heat dissipation openings 105 and an electronic component.

Referring to FIGS. 10-14, the driving device 4 is a brushless driving device 4. The brushless driving device 4 includes a stator winding part 44, a permanent magnet rotor part 45, a driver 46, and a position detection device 47. The permanent magnet rotor part 45 is positioned inside the water intake cavity 3. The position detection device 47 is used for detecting a position of the permanent magnet rotor part 45. The driver 46 is used for sequentially energizing the stator winding part 44 according to the position of the permanent magnet rotor part 45 in a specific order, so that a magnetic field of the stator winding part 44 always maintains an angular difference with a magnetic field of the permanent magnet rotor part 45, thereby generating continuous torque to push the permanent magnet rotor part 45 to rotate, thus making the permanent magnet rotor part 45 rotate to push water in the water intake cavity 3 and the first accommodating cavity 13 to flow. A positioning column 31 is configured for extending from an inner wall of the water intake cavity 3. The permanent magnet rotor part 45 is provided with a first installation hole 431. The permanent magnet rotor part 45 is rotatably sleeved on the positioning column 31 through the first installation hole 431, so that the permanent magnet rotor part 45 is rotatable around an axis of the positioning column 31. Specifically, the permanent magnet rotor part 45 includes a connecting housing 451 and a permanent magnet 452. The permanent magnet 452 is connected to the connecting housing 451. An outer surface of the connecting housing 451 is connected to a plurality of fan blades 432. In some embodiments, the permanent magnet 452 is connected to an inner surface of the connecting housing 451. Through the above structure, the driver 46 is used for sequentially energizing the stator winding part 44 in a specific order according to the position of the permanent magnet rotor part 45, so that the magnetic field of the stator winding part 44 always maintains an angular difference with the magnetic field of the permanent magnet rotor part 45, thereby generating continuous torque to push the permanent magnet rotor part 45 to rotate, thus making the fan blades 432 of the permanent magnet rotor part 45 rotate to push the water in the water intake cavity 3 and the first accommodating cavity 13 to flow.

In this embodiment, the first accommodating cavity 13 is provided with a first accommodating opening 131. The scene decoration article further includes an inner container 6. The inner container 6 is provided with a second inner side wall 61 and a second outer side wall 62. The inner container 6 is placed into the first accommodating cavity 13 through the first accommodating opening 131. An accommodating gap 63 is defined between the second outer side wall 62 of the inner container 6 and the first inner side wall 11 of the outer housing 1. The accommodating gap 63 is used for accommodating liquid. The driving device 4 is used for pushing the water in the accommodating gap 63 and the water intake cavity 3 to flow. Through the above structure, the water can be injected into the storage gap 63 formed between the inner container 6 and the outer housing 1, narrowing an accommodating space, reducing the water injection, and making the scene decoration article more lightweight while having the decorative effect. Moreover, due to the driving device 4 that pushes the water in the accommodating gap 63 to flow, the water in the accommodating gap 63 can be pushed to form the effect of the circulating water flow, which has a better effect in decorating a scene and a higher ornamental value compared with static water.

In this embodiment, the outer housing 1 is a transparent outer housing 1, and the inner container 6 is a transparent inner container 6. A bottom portion of the inner container 6 is provided with support feet 64. When the inner container 6 is placed in the first accommodating cavity 13, the support feet 64 are configured for supporting on a bottom portion of the first inner side wall 11. Through the above structure, the assembly between the inner container 6 and the outer housing 1 is effectively achieved. Moreover, since the support feet 64 are configured for supporting on the bottom portion of the first inner side wall 11, the accommodating gap 63 for accommodating liquid is defined between the bottom portion of the inner container 6 and a bottom portion of the outer housing 1.

In this embodiment, the scene decoration article further includes an installation housing 7 and a support base 8. The installation housing 7 is connected to the support base 8. A third accommodating cavity 71 is defined in the installation housing 7. A third accommodating opening 72 is defined in a lower side of the installation housing 7. A fourth accommodating opening 73 is defined in an upper side of the installation housing 7. The third accommodating opening 72 and the fourth accommodating opening 73 are both in communication with the third accommodating cavity 71. The outer housing 1 is placed in the third accommodating cavity 71 through the third accommodating opening 72. The support base 8 is used for supporting a bottom portion of the outer housing 1.

In this embodiment, an upper side of the inner container 6 extends to form a covering portion 9. The first accommodating opening 131 is in communication with the first accommodating cavity 13. The inner container 6 is placed into the first accommodating cavity 13 through the first accommodating opening 131. The upper side of the inner container 6 is connected to an upper side of the outer housing 1 through the covering portion 9, so that the covering portion 9 seals and covers the accommodating gap 63. The outer housing 1 is equipped with a positioning convex block 15. A positioning groove 91 is defined in the covering portion 9. The positioning convex block 15 is connected to the positioning groove 91 in an embedded manner. Through the above structure, the sealing of the accommodating gap 63 by the covering portion 9 is effectively achieved, preventing the water in the accommodating gap 63 from overflowing, especially preventing the dynamic circulating water flow formed by the driving device 4 pushing the water in the accommodating gap 63 from overflowing. The inner container 6 is provided with a fourth accommodating cavity 65 and a second accommodating opening 651. The second accommodating opening 651 is in communication with the fourth accommodating cavity 65. The fourth accommodating cavity 65 is surrounded and formed by the second inner side wall 61. The fourth accommodating cavity 65 is used for accommodating a decorative item.

In this embodiment, the scene decoration article further includes a top cover 101. The top cover 101 is configured for detachably covering the fourth accommodating opening 73. A lower side of the top cover 101 is pressed against the top portion of the outer housing 1, so that the outer housing 1 is pressed against an upper surface of the support base 8. The scene decoration article further includes a handle 103. The handle 103 is rotatably connected to the top cover 101 through a first rotating shaft 104.

Referring to FIGS. 10-14, the driving device is positioned at a top portion of the outer housing. The top cover 101 is provided with heat dissipation openings 105 and an electronic component.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A scene decoration article, comprising:

an outer housing, wherein the outer housing is provided with a first inner side wall and a first outer side wall; the first inner side wall surrounds and forms a first accommodating cavity; the first accommodating cavity is used for accommodating liquid; and a surface of the first inner side wall is recessed to form an installation inner wall;

a cover part, wherein the cover part is configured for covering the installation inner wall to form a water intake cavity between the cover part and the installation inner wall; the cover part is provided with a first water inlet; the installation inner wall is provided with a first water outlet; and the first accommodating cavity, the first water inlet, the water intake cavity, and the first water outlet are in communication with each other; and a driving device, wherein the driving device is used for pushing the liquid in the first accommodating cavity to flow through the first water inlet, the water intake cavity, and the first water outlet in sequence, and to be discharged into the first accommodating cavity through the first water outlet to form a circulating water flow.

2. The scene decoration article according to claim 1, wherein the cover part is configured for covering a top portion of the installation inner wall; and the first water outlet is provided on a side portion of the installation inner wall.

3. The scene decoration article according to claim 1, wherein an installation opening is defined in a top portion of the installation inner wall; and the cover part is configured for covering the installation opening, so that the water intake cavity is formed between the cover part and the installation inner wall.

4. The scene decoration article according to claim 1, further comprising a flow guide channel, wherein the flow guide channel is provided with a first end and a second end; the first end of the flow guide channel is in communication with the first water outlet; the second end of the flow guide channel extends into the first accommodating cavity; the second end is provided with a second water outlet; the first accommodating cavity, the first water inlet, the water intake cavity, the first water outlet, the flow guide channel, and the second water outlet are in communication with each other; the driving device is used for pushing the liquid in the first accommodating cavity to flow through the first water inlet, the water intake cavity, and the first water outlet in sequence, and to be discharged into the first accommodating cavity through the first water outlet, the flow guide channel, and the second water outlet to form the circulating water flow.

5. The scene decoration article according to claim 4, wherein a surface of the first inner side wall is recessed to form a flow guide inner wall; the cover part extends to form a flow guide cover; and the flow guide cover is configured for covering at least one part of the second water outlet, so that the flow guide channel is formed between the flow guide cover and the flow guide inner wall.

6. The scene decoration article according to claim 4, further comprising a partition part, wherein the partition part extends from the first end to the second end; the partition part divides the first water outlet into a first water outlet unit and a second water outlet unit; the partition part divides the flow guide channel into a first flow guide unit and a second flow guide unit; and the partition part divides the second water outlet into a third water outlet unit and a fourth water outlet unit.

7. The scene decoration article according to claim 6, wherein the flow guide cover is configured for covering at least one part of the third water outlet unit and at least one part of the fourth water outlet unit, so that the flow guide channel is formed between the flow guide cover and the flow guide inner wall.

8. The scene decoration article according to claim 5, wherein the flow guide cover is in an annular sector shape.

9. The scene decoration article according to claim 5, wherein the flow guide inner wall and the installation inner wall are arranged to be mutually inclined to form an included angle; and an inner diameter of the flow guide channel gradually decreases from a first end to a second end.

10. The scene decoration article according to claim 5, wherein a top portion of the installation inner wall is provided with a first installation groove; the cover part is provided with a first installation protrusion; a top portion of the flow guide inner wall is provided with a second installation groove; the flow guide cover is provided with a second installation protrusion; the first installation protrusion is detachably connected to the first installation groove; and the second installation protrusion is detachably connected to the second installation groove.

11. The scene decoration article according to claim 10, wherein the first installation groove is in communication with the second installation groove; and the first installation protrusion is connected to the second installation protrusion.

12. The scene decoration article according to claim 1, wherein the driving device comprises a driving motor, a first magnetic attraction member, and a second magnetic attraction member; the second magnetic attraction member is positioned inside the water intake cavity; the driving motor is provided with a driving output shaft; the first magnetic attraction member is sleeved on the driving output shaft; when the first magnetic attraction member rotates with the driving output shaft, the first magnetic attraction member drives the second magnetic attraction member arranged in the water intake cavity to rotate, so that the second magnetic attraction member pushes water in the water intake cavity and the first accommodating cavity to flow.

13. The scene decoration article according to claim 12, wherein a positioning column is configured for extending from an inner wall of the water intake cavity; a first installation hole is defined in the second magnetic attraction member; and the second magnetic attraction member is rotatably sleeved on the positioning column through the first installation hole, so that the second magnetic attraction member is rotatable around an axis of the positioning column.

14. The scene decoration article according to claim 12, wherein a plurality of fan blades are configured for extending from an outer surface of the second magnetic attraction member; the second magnetic attraction member comprises a bottom housing and an upper housing; the upper housing is connected to the bottom housing; a second accommodating cavity is formed between the upper housing and the bottom housing; and a plurality of first magnetic attraction blocks are arranged inside the second accommodating cavity.

15. The scene decoration article according to claim 14, wherein a plurality of annular protrusions are configured for extending from an inner wall of the second accommodating cavity; the annular protrusion surrounds and forms a first position limiting groove; and the first magnetic attraction block is positioned within the first position limiting groove.

16. The scene decoration article according to claim 12, wherein an installation portion is configured for extending from a surface of the first outer side wall; the driving motor is connected to the installation portion; and the first magnetic attraction member, which is sleeved on the driving output shaft of the driving motor, is oriented towards the second magnetic attraction member, so that the first magnetic attraction member is capable of driving the second magnetic attraction member positioned inside the water intake cavity to rotate, thus allowing the second magnetic attraction member to push the water in the water intake cavity and the first accommodating cavity to flow.

17. The scene decoration article according to claim 1, wherein the driving device is a brushless driving device; the brushless driving device comprises a stator winding part, a permanent magnet rotor part, a driver, and a position detection device; the permanent magnet rotor part is positioned inside the water intake cavity; the position detection device is used for detecting a position of the permanent magnet rotor part; and the driver is used for sequentially energizing the stator winding part according to the position of the permanent magnet rotor part in a specific order, so that a magnetic field of the stator winding part always maintains an angular difference with a magnetic field of the permanent magnet rotor part, thereby generating continuous torque to push the permanent magnet rotor part to rotate, thus making the permanent magnet rotor part rotate to push water in the water intake cavity and the first accommodating cavity to flow.

18. The scene decoration article according to claim 17, wherein a positioning column is configured for extending from an inner wall of the water intake cavity; the permanent magnet rotor part is provided with a first installation hole; and the permanent magnet rotor part is rotatably sleeved on the positioning column through the first installation hole, so that the permanent magnet rotor part is rotatable around an axis of the positioning column.

19. The scene decoration article according to claim 17, wherein the permanent magnet rotor part comprises a connecting housing and a permanent magnet; the permanent magnet is connected to the connecting housing; an outer surface of the connecting housing is connected to a plurality of fan blades; and the permanent magnet is connected to an inner surface of the connecting housing.

20. The scene decoration article according to claim 1, wherein the first accommodating cavity is provided with a first accommodating opening; the scene decoration article further comprises an inner container; the inner container is provided with a second inner side wall and a second outer side wall; the inner container is placed into the first accommodating cavity through the first accommodating opening; an accommodating gap is defined between the second outer side wall of the inner container and the first inner side wall of the outer housing; the accommodating gap is used for accommodating liquid; the driving device is used for pushing water in the accommodating gap and the water intake cavity to flow; a bottom portion of the inner container is provided with support feet; when the inner container is placed in the first accommodating cavity, the support feet are configured for supporting on a bottom portion of the first inner side wall; the scene decoration article further comprises an installation housing and a support base; the installation housing is connected to the support base; a third accommodating cavity is defined in the installation housing; a third accommodating opening is defined in a lower side of the installation housing; a fourth accommodating opening is defined in an upper side of the installation housing; the third accommodating opening and the fourth accommodating opening are both in communication with the third accommodating cavity; the outer housing is placed in the third accommodating cavity through the third accommodating opening; the support base is used for supporting a bottom portion of the outer housing; an upper side of the inner container extends to form a covering portion; the upper side of the inner container is connected to an upper side of the outer housing through the covering portion, so that the covering portion seals and covers the accommodating gap; the outer housing is equipped with a positioning convex block; a positioning groove is defined in the covering portion; and the positioning convex block is connected to the positioning groove in an embedded manner.

* * * * *